US005330012A

United States Patent [19]

Morrison

[11] Patent Number: 5,330,012

[45] Date of Patent: Jul. 19, 1994

[54] FEED SHELL LUBRICATION MANIFOLD

[75] Inventor: Ward D. Morrison, Claremont, N.H.

[73] Assignee: Cannon Industries, Inc., Claremont, N.H.

[21] Appl. No.: 998,814

[22] Filed: Dec. 30, 1992

[51] Int. Cl.[5] ..... E21C 5/00

[52] U.S. Cl. ..... 173/141; 173/DIG. 3

[58] Field of Search ..... 173/DIG. 3, 141, 145, 173/148, 150, 151, 37, 36

[56] References Cited

U.S. PATENT DOCUMENTS

| | | | |
|---|---|---|---|
| 1,408,176 | 2/1922 | H'Doubler | 173/141 X |
| 1,502,383 | 7/1924 | Guerrini et al. | 173/141 X |
| 1,604,957 | 11/1926 | Bayles | 173/141 |
| 1,868,650 | 7/1932 | Wilhelm | 173/141 |
| 2,365,681 | 12/1944 | Gartin | 173/141 X |
| 3,565,185 | 2/1971 | Ekwall | 173/160 X |
| 4,314,611 | 2/1982 | Willis | 173/DIG. 3 X |

*Primary Examiner*—Rinaldi Rada
*Attorney, Agent, or Firm*—Michael J. Weins

[57] ABSTRACT

The present invention is for an improved feed shell for an air-flushing, rock-drilling system. The improvement extends the life of the feed shell and, in particular, the feed guide of a feed shell on which gibs for directing a rock drill ride. The system, as improved, provides a first nozzle which directs fluid onto a first guide surface of the feed guide and second nozzle which directs fluid onto a second guide surface of the feed guide. The nozzles can be mounted in either manifolds or, alternatively, in the gibs which support and guide the drill on the feed guide.

8 Claims, 3 Drawing Sheets

FEED SHELL LUBRICATION MANIFOLD

FIELD OF INVENTION

The present invention relates to a feed shell for rock drills and, more particularly, to a cleaning and lubrication attachment for a feed guide.

BACKGROUND OF THE INVENTION

Rock drills are frequently guided by feed shells which have a feed guide for directing the rock drill. Feed guides are often times fabricated from aluminum to reduce the weight of the feed shell which also serves to improve the strength/weight ratio. An adapter plate onto which the rock drill mounts is fitted with gibs which slidably engage guiding surfaces of the feed guide. The sliding contact can result in excessive wear of the gibs and guide surfaces, particularly when operating in a drilling environment laden with rock fragments.

Rock drilling, by its very nature, produces rock fragments, while drilling a hole, which need to be flushed from the hole as the drill advances. When a liquid is used to flush the holes being drilled, the operating environment of the feed shell remains reasonably friendly. However, when the flushing fluid is air rather than a liquid, the environment becomes hostile and the service life of the guiding surfaces of the feed guide is substantially reduced from the life which can be obtained when liquids are used as the flushing agent.

When drilling a rock substrate such as limestone, the operating life for the guide surfaces of the feed guide can be as short as four (4) months when air flushing is employed. Thereafter, the feed guide needs replacing. Thus, there is a need for an improved feed shell for mounting air flushing drills which extends the operating time before service or rebuilding of the feed shell is required.

SUMMARY OF THE INVENTION

The present invention extends the life of feed shells for air flushing rock drill systems. The feed shell on which the improvement is used has a feed guide with a first guide surface and a second guide surface. Gibs are provided which slidably engage the first and second guide surfaces. The rock drill is either attached to the gibs or, alternatively, to an adapter plate which, in turn, is attached to the gibs. In this way, the guide surfaces, in combination with the gibs, serve to locate the drill with respect to the feed shell.

The improvement of the present invention is an attachment which, in its simplest form, is a pair of nozzles. A first nozzle is positioned to direct fluid onto the first guide surface; a second nozzle is positioned to direct fluid onto the second guide surface.

When the gibs are arranged to provide a pair of leading gibs and a pair of trailing gibs then, preferably, the first nozzle and the second nozzle are positioned such that they direct a stream of fluid onto the guide surfaces ahead of the leading gibs, the gibs in closest proximity to the rock being drilled. Having the nozzles so positioned directs the fluid to a region of the guide surface which lies ahead of the gibs when the rock drill bit advances into the rock and provides cleaning and lubrication of the guide surfaces as the gibs advance.

It is further preferred that a third nozzle and fourth nozzle are provided. The third nozzle and the fourth nozzle are positioned such that they direct a stream of fluid onto the guide surfaces behind the pair of trailing gibs, the gibs furthest from the rock being drilled. Having the third nozzle and fourth nozzle so positioned directs fluid onto the guide surfaces which lie behind the gibs as the drill is retracted and will provide fluid ahead of the trailing gibs as the drill is retracted. The third and the fourth gibs provide the cleaning and lubrication of the guide surfaces when the drill bit is being withdrawn from the rock.

In both cases where a first nozzle and second nozzle are employed as well where the first nozzle and the second nozzle are employed in combination with a third nozzle and a fourth nozzle, the preferred fluid is air and, more preferably, air lubricated with either water or oil. It is still further preferred that the nozzles have multiple nozzle passages to direct fluid onto the guide surfaces.

In one preferred embodiment, the nozzles are mounted in manifolds. A first manifold houses the first nozzle which has one or more nozzle passages for directing fluid onto the first guide surface. A second manifold houses the second nozzle which has one or more nozzle passages for directing fluid onto the second guide surface. The nozzles and the manifolds may be an integrated structure. Air, since compressed air is readily available in air flushing systems, is the preferred fluid.

It is preferred that the first manifold have a first manifold inlet port which connects to a first manifold passage which, in turn, communicates with one or more nozzle passages of the first nozzle housed in the first manifold. Similarly, it is preferred that the second manifold have a second manifold inlet port which connects to a second manifold passage which, in turn, communicates with one or more nozzle passages of the second nozzle housed in the second manifold. It is still further preferred that the first manifold have a transfer port which communicates with the first manifold passage. A transfer duct is provided which connects the transfer port to the second manifold inlet port.

When a third nozzle and a fourth nozzle are employed, which clean and lubricate the guide surface as the drill is being withdrawn, it is preferred that the additional nozzles have multiple passages and that manifolds are provided.

In another preferred configuration, the nozzles are mounted on the gibs. Alternatively, the gibs can be configured so as to serve as manifolds for the nozzles.

When feed shells have guide surfaces with multiple runs along which the gibs ride, it is preferred that the nozzles with multiple passages be employed and that the individual nozzle passages be positioned to direct a stream of fluid onto each of the runs.

Means for supplying fluid to the nozzles are provided. The fluid may be either directly supplied to the nozzles or may be supplied to the manifolds which, in turn, supply fluid to the nozzle passages. If one taps one of the air supply lines employed in an air flushing drilling system, then the tap serves as the means for supplying fluid. Examples of lines which can be tapped are the flushing air line, the air drill supply line, the exhaust manifold of the air drill, and the chuck lubrication line of hydraulic drills. Any of these lines can provide a source of air for cleaning and lubrication of the guide surfaces.

When flushing air is used, it frequently has water present and this water serves as a lubricant. The water may be present as a result of natural humidity or may be intentionally added to suppress dust. If the air for the drill is lubricated with oil, which is frequently done to provide lubrication for the chucks of hydraulic drills, then a bleed off, tapping the oil lubricated air line for the chuck, will provide air lubricated with oil.

BEST MODE OF CARRYING THE INVENTION INTO PRACTICE

Figure 1:
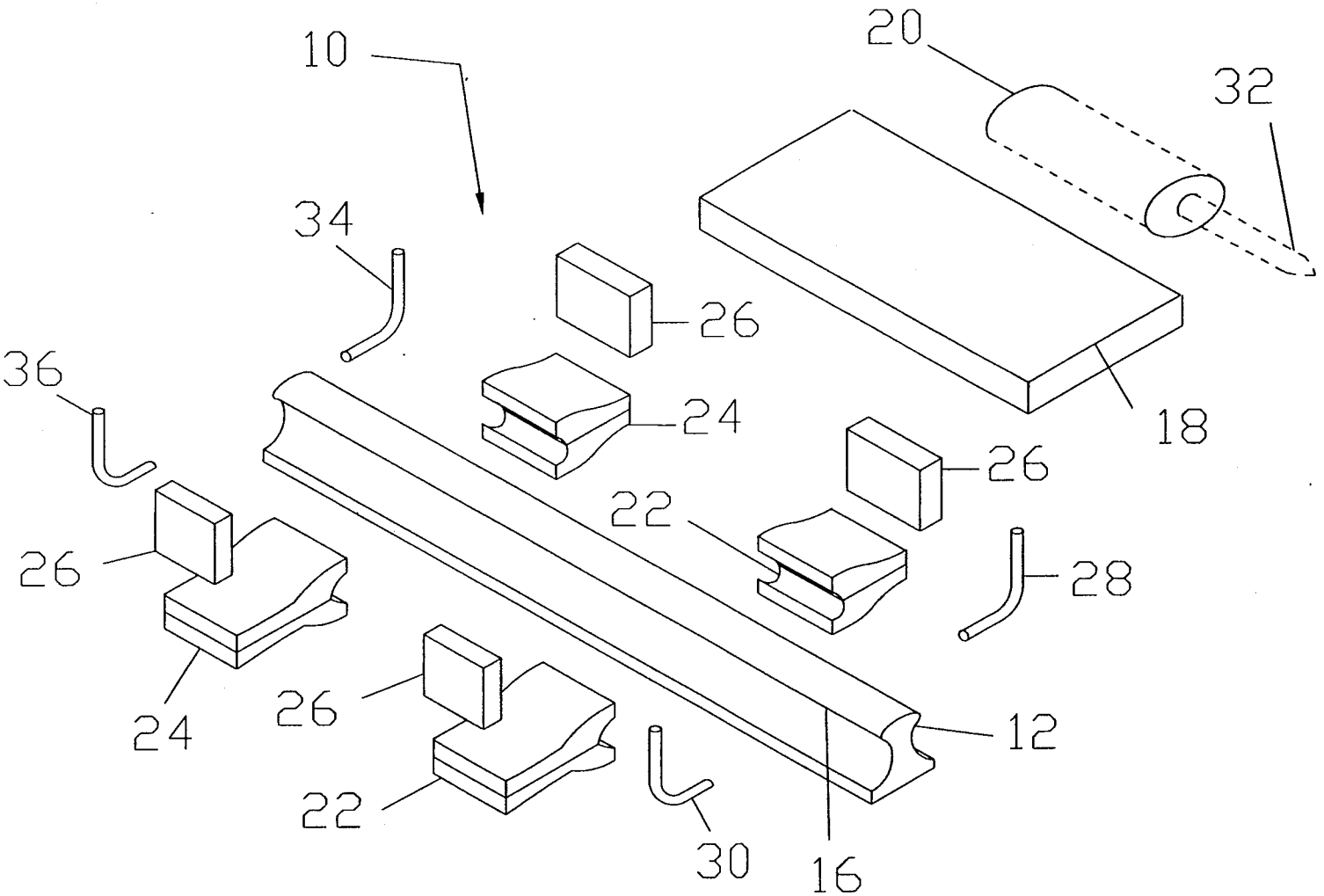
FIG. 1 is an exploded view of one embodiment of an improved feed shell for a rock drill of the present invention. The feed shell has a first pair of nozzles providing fluid to the guide surfaces of the feed guide ahead of the advancing rock drill as well as a second pair of nozzles providing fluid to the feed guide as the rock drill is withdrawn.

FIG. 1 is an exploded view of a feed shell 10 with one embodiment of the improvement of the present invention. The feed shell 10 is employed on a rock drilling system. The feed shell 10 has a feed guide 12 with first guide surface 14 and a second guide surface 16. An adapter plate 18 is provided which supports a drill 20 (shown in phantom lines). The adapter plate 18 is supported by a pair of leading gibs 22 which are in closest proximity to the rock being drilled and a pair of trailing gibs 24 which are at the greatest distance from the rock being drilled. Spacers 26 are interposed between the gibs 22 and 24 and the adapter plate 18. The gibs 22 and 24 slidably engage the guide surfaces 14 and 16 of the feed guide 12 and, in combination with the spacers 26 and the adapter plate 18, direct the drill 20. While the embodiment of FIG. 1 employs an adapter plate 18 and spacer 26 to attach to leading gibs 22 and the trailing gibs 24 to the drill 20, the gibs 22 and 24 could be configured to directly engage the drill 20.

The improvement of the feed shell 10 of FIG. 1 is provided by multiple nozzles which direct fluid onto the guide surfaces 14 and 16. A first nozzle 28 is attached to the adapter plate 18 and is positioned with respect the first guide surface 14 such that the nozzle will direct a stream of fluid thereon; and a second nozzle 30 is also attached to the adapter plate 18 and is positioned with respect to the second guide surface 16 such that the second nozzle will direct a stream of fluid thereon.

The first nozzle 28 and the second nozzle 30 are positioned such that fluid is provided to a region of the feed guide 12, which lies ahead of the leading gibs 22; ahead of the leading gibs is defined as the region which lies forward of the leading gibs 22 as the drill bit 32 is advanced. Having the nozzles 28 and 30 so positioned provides a stream of fluid onto the guide surfaces 14 and 16 in advance of the leading gibs 22 and cleans the guide surfaces of chips as the rock drill 20 is advanced.

Having the gibs move forward on clean guide surfaces 14 and 16 as the drill bit 32 advances into the rock is particularly important since the load on the gibs will be high and tend to accentuate the wear.

It is also preferred that guide surfaces 14 and 16 be cleaned as the drill bit 32 is withdrawn from the rock, however, the wear is substantially less since the load borne by the gibs to the guide surfaces 14 and 16 is usually low as compared to the load when the drill is being advanced into the rock.

When cleaning of the guide surfaces 14 and 16 is to be provided as the drill bit 32 is being withdrawn, a third nozzle 32 is employed to clean and lubricate the first guide surface 14. A fourth nozzle 36 is employed for cleaning and lubricating the second guide surface 16.

The third nozzle 34 and the fourth nozzle 36 are attached to the adapter plate 18 and positioned such that the nozzles 34 and 36 provide fluid to the guide surfaces 14 and 16 in a region behind the trailing gibs 24. In this way, the nozzles 34 and 36 clean the guide surfaces 14 and 16 ahead of the trailing gibs 24 as the drill bit 32 is withdrawn from the rock.

Since air flushing drill systems inherently have supply lines for compressed air, it is it is advantageous to employ air as the fluid for the nozzles 28, 30, 34, and 36. Thus, it is preferred that the fluid for the nozzles 28, 30, 34 and 36 be air. It is further preferred that the air be lubricated to further reduce wear resulting from the gibs 22 and 24 riding on the feed guide 12.

The air may be lubricated with either water or oil suspended therein as droplets. Lubrication of the air can be provided in various ways and, in some instances, it may be naturally occurring. When the flushing air is compressed, the humidity of the ambient air frequently results in condensation of water droplets. If the humidity is low, water may be added to increase the water content of the compressed air. When the water content in the flushing air is maintained at a level sufficient to suppress dust, this level is sufficient to lubricate the guides. Alternatively, water can be added to the air supplied to the nozzles by aspiration or by other techniques.

Similarly, oil can be aspirated into the air stream if oil lubrication is sought. In the case where hydraulic drills are used in combination with air flushing, oil lubricated air is frequently employed to lubricate the chucks. In this case, there is a source of oil lubricated air readily available.

Figure 2:
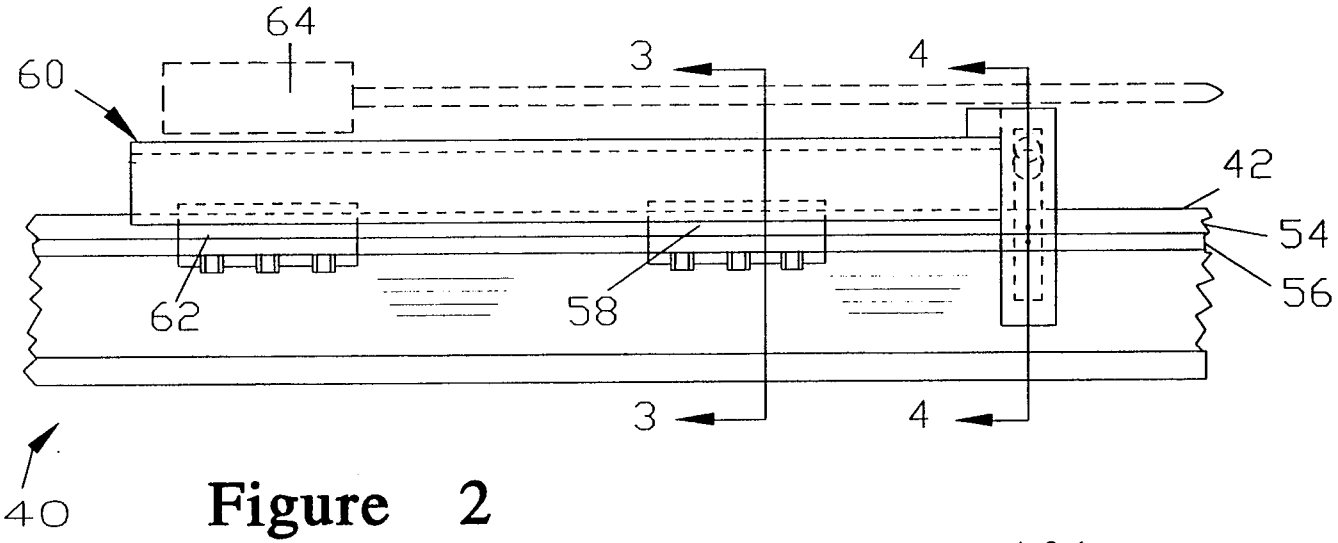
FIG. 2 is a side elevation view of a second embodiment of a feed shell employing an improvement of the present invention. This embodiment employs a pair of manifolds which position the nozzles so that they will provide fluid to the guide surfaces of the feed guide. The nozzles provide fluid to the guide surfaces ahead of the gibs as the drill advances into the rock.
Figure 4:
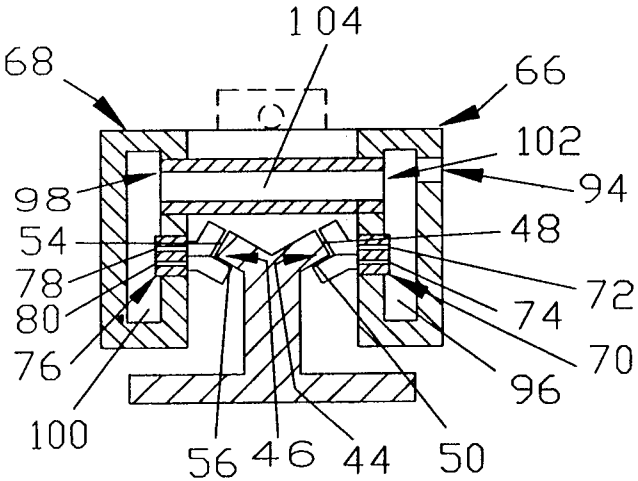
FIG. 4 is a cross section of the section 4—4 of FIG. 2. It shows the manifolds in cross section, exposing the manifold passages and showing their interconnection as well as the placement of the nozzle passages with respect to the runs on the guide surfaces.
Figure 3:
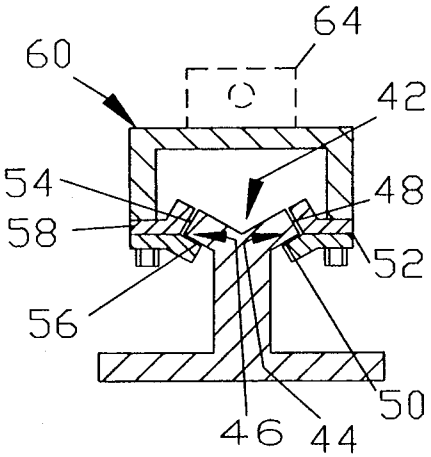
FIG. 3 is section 3—3 of the feed shell of FIG. 2, showing a pair of gibs slidably engaged with the feed guide.

FIGS. 2–4 illustrate a second preferred embodiment of the present invention where the nozzles are housed in manifolds and the nozzles have multiple nozzle passages which direct fluid onto the guide surfaces.

FIG. 2 is a side elevation view showing a feed shell 40 having a feed guide 42. The feed guide 42 has a first guide surface 44 and a second guide surface 46 which are shown in FIGS. 3 and 4. The first guide surface 44 has a first run 48 and a second run 50 on which a first gib 52 rides. Similarly, the second guide surface 46 has a third run 54 and a fourth run 56 on which a second gib 58 rides. The third run 54 and the fourth run 56 are also shown in FIG. 2 and 3. The first gib 52 and the second gib 58 are positioned to form a pair of lead gibs which direct and stabilize movement of an adapter plate 60. A pair of trailing gibs (one of which is shown as 62 in FIG. 2) further supports and stabilizes the movement of the adapter plate 60. The gibs attach to the adapter plate 60 which in turn supports a drill 64. The multiple runs provide additional stabilization of the adapter plate 60 and of the drill 64. This additional stabilization is particularly important when the drill is being advanced since there will be a large moment on the gibs when the drill 64 is being advanced.

FIG. 4 is a cross section 4—4 of FIG. 2 and shows a cross section of a first manifold 66 and a second manifold 68. The nozzles can be either a separate entity or can be an integral part of the manifolds. The first manifold 66 contains a first nozzle 70. The first nozzle 70, in turn, has a first nozzle passage 72 positioned to direct a stream of air onto the first run 48 while a second nozzle passage 74, is positioned to provide a stream of air onto the second run 50. Having the first nozzle passage 72 and the second nozzle passage 74 so positioned will assure that the first run 48 and the second run 50 have air streams directed thereon.

Similarly, a second nozzle 76 has a third nozzle passage 78 and is positioned to direct a stream of air onto the third run 54 while a fourth nozzle passage 80 is positioned to direct a stream of air onto the fourth run 56. It should be appreciated that additional passages can be provided to the nozzle if a more distributed flow is desired.

The passages in the nozzles are preferably between about 0.032 inches and 0.19 inches. The lower limit provides an opening of sufficient size as to avoid fouling. The upper limit throttles the air flow so as to limit air consumption.

The first manifold 66 has a first manifold inlet port 94, which connects to a first manifold passage 96, which in turn communicates with the first nozzle passage 72 and the second nozzle passage 74, housed in the first manifold 66.

Similarly, the second manifold 68 has a second manifold inlet port 98, which connects to a second manifold passage 100, which in turn communicates with the third nozzle passage 78 and the fourth nozzle passage 80, housed in the second manifold 68.

The first manifold 66 has a transfer port 102 which communicates with the first manifold passage 96, and that a transfer duct 104 connect the transfer port 102 to the second manifold inlet port 98.

While the structure of FIGS. 2–4 has been described in terms of a first manifold 66 and a second manifold 68 which are connected to a transfer duct 104, it should be appreciated that the first manifold 66, the second manifold 68, and the transfer duct 104 can be described as a composite manifold and, if so described, then the first nozzle 70 and the second nozzle 76 are housed in this composite manifold.

As discussed earlier, there are various options for supplying air for the nozzles. If the air from the compressor used to provide flushing air is moist, then the air will be lubricated by water drops; alternatively, if the air for the drill is lubricated with oil, tapping the exhaust manifold will provide air lubricated with oil.

It is preferred that the pressure of the air be between about 10 and 110 psi. with the pressure and nozzle passage size selected to provide a flow rate of 1–15 CFM.

Figure 5:
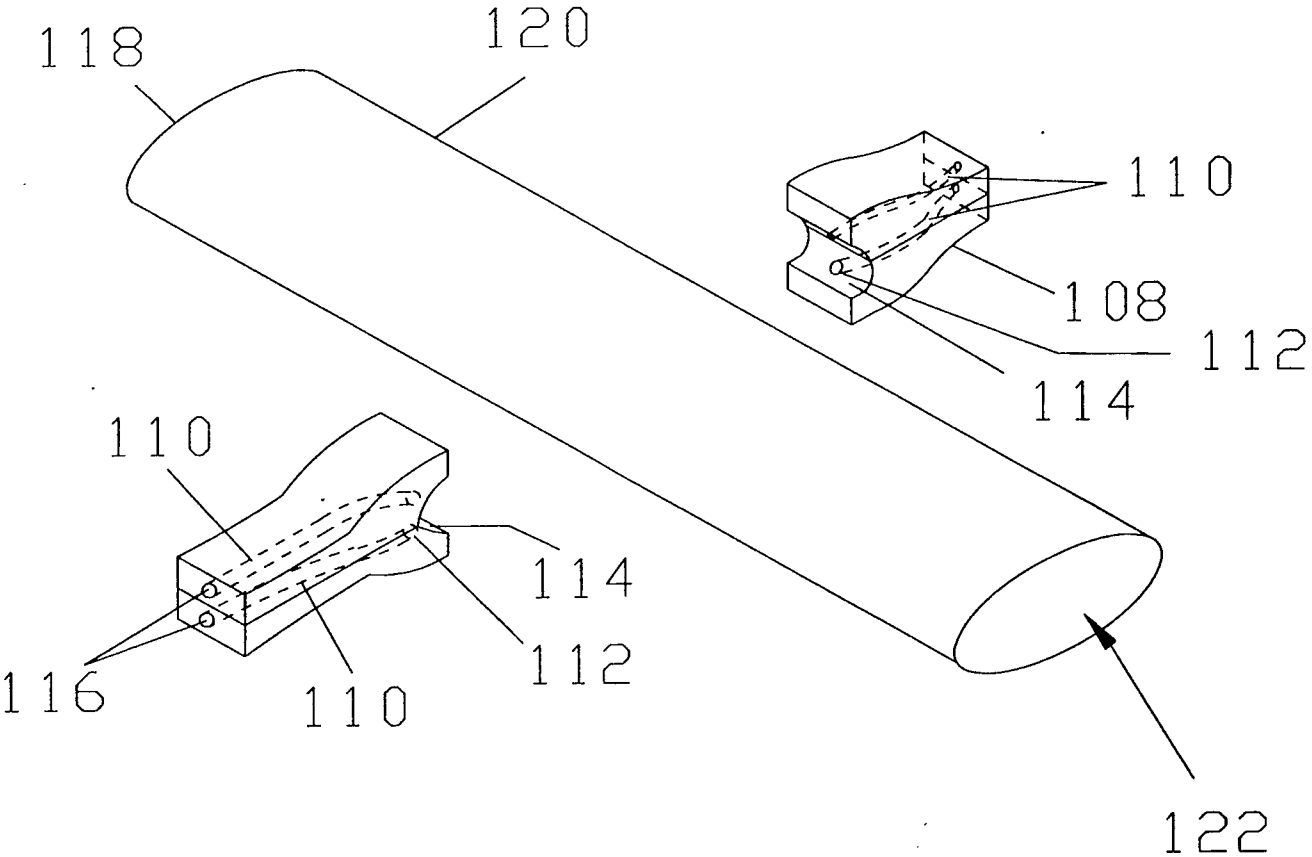
FIG. 5 is another embodiment where the nozzles are integrated into the gibs which serve as the manifolds for the nozzles.

FIG. 5 illustrates a pair of nozzles containing gibs 108 which are employed for another embodiment of the invention. Each of the gibs 108 has a pair of passages 110 which terminate at one end in a pair of nozzles 112 which are integrated into feed guide engaging surfaces 114 of the gibs 108. At the other end they terminate in a pair of entry ports 116 which are connected to an air supply. The nozzles 112 are positioned to direct fluid onto guide surfaces 118 and 120 of a feed guide 122. With the nozzles so positioned as the gibs 108 ride on the feed guide 122, fluid flowing over the guide surfaces 118 and 120 will eliminate rock fragments by the path of the gibs.

In order to better illustrate the benefit of the present invention, the following example is provided.

EXAMPLE

A feed shell, similar to the feed shell illustrated in FIG. 2, was fitted with a manifold having nozzles which direct air stream onto a feed guide. The nozzle had passages with an orifice size of 0.045 inches and the air pressure was 90 psi. providing a flow rate of 3 CFM.

An aluminum alloy feed guide was used which mated with steel gibs supporting the adapter plate.

The feed guide was fitted with a Cannon CH 38 drill. An air flushing system was provided to remove debris from the holes. The air contained a small amount of water in suspension typical of the levels employed for dust suppression.

The manifolds housing the nozzles were provided with air from the flushing air supply with the water of the flushing air serving as a lubricant in the flushing air.

The feed shell, of this example, was operated on twelve hour shifts five days a week. Under these conditions, a wear rate of 1/16th of an inch in an eight month period was observed. The equivalent system operating under the same conditions, but without the improvement of the present invention, typically had a wear rate of 1/16" per month. Thus, there was an eight fold increase resulting from the implementation of the present invention.

While this invention has been described in terms of preferred embodiments, it should be appreciated by those skilled in the art that variation and modifications may be made without departing from the spirit of the invention.

What I claim is:

1. An improved feed shell for a rock drill having a feed guide, gibs which ride on a first guide surface and a second guide surface of the feed guide, the gibs in combination with the first guide surface and the second guide surface directing the rock drill, the improvement comprising:

a first nozzle attached to the feed shell, said first nozzle being positioned with respect to the first guide surface such that said first nozzle directs fluid onto the first guide surface;

a second nozzle attached to the feed shell, said second nozzle being positioned with respect to the second guide surface such that said second nozzle directs fluid onto the second guide surface; and means for supplying fluid to said first nozzle and said second nozzle, wherein the gibs form a pair of leading gibs and a pair of trailing gibs; and further wherein said first nozzle and said second nozzle are positioned such that they direct fluid onto the first guide surface and the second guide surface ahead of the pair of leading gibs.

2. The improved feed shell of claim 1 further comprising:

a third nozzle attached to the feed shell, said third nozzle being positioned with respect to the first guide surface such that said third nozzle directs fluid onto the first guide surface behind the pair of trailing gibs; and a fourth nozzle attached to the feed shell, said fourth nozzle being positioned with respect to the second guide surface such that said fourth nozzle directs fluid onto the second guide surface behind the pair of trailing gibs.

3. An improved feed shell for a rock drill having a feed guide, gibs which ride on a first guide surface and a second guide surface of the feed guide, the gibs in combination with the first guide surface and the second guide surface directing the rock drill, the improvement comprising:

a first nozzle having a first nozzle passage, said nozzle being attached to the feed shell and positioned with respect to the first guide surface such that said first nozzle directs fluid onto the first guide surface;

a second nozzle having a second nozzle passage, said second nozzle being attached to the feed shell and positioned with respect to the second guide surface such that said second nozzle directs fluid onto the second guide surface;

means for supplying fluid to said first nozzle and said second nozzle;

a first manifold housing said first nozzle having a first manifold input port for fluid;

a first manifold passage which communicates with said first manifold port and said first passage in said first nozzle;

a second manifold housing said second nozzle having a second manifold input port for fluid; and a second manifold passage which communicates with said second manifold input port and said first passage in said second nozzle.

4. The improved feed shell of claim 3 further comprising:

a transfer port communicating with said first manifold passage; and a transfer duct connecting with said transfer port and said second manifold input port.

5. The improved feed shell of claim 4 wherein the first guide surface has a first run onto which said first nozzle passage of said first nozzle directs fluid, and a second run onto which a second nozzle passage of said first nozzle directs fluid; and the second guide surface has a third run onto which said first nozzle passage of said second nozzle directs fluid, and a fourth run onto which a second nozzle passage of said second nozzle directs fluid.

6. An improved feed shell for a rock drill having a feed guide, gibs which ride on a first guide surface and a second guide surface of the feed guide, the gibs in combination with the first guide surface and the second guide surface directing the rock drill, the improvement comprising:

a first nozzle having a first nozzle passage, said nozzle being attached to the feed shell and positioned with respect to the first guide surface such that said first nozzle directs fluid onto the first guide surface;

a second nozzle having a second nozzle passage, said second nozzle being attached to the feed shell and positioned with respect to the second guide surface such that said second nozzle directs fluid onto the second guide surface, wherein said first nozzle and said second nozzle form part of the gibs;

means for supplying fluid to said first nozzle and said second nozzle;

a first manifold housing said first nozzle having a first manifold input port for fluid;

a first manifold passage which communicates with said first manifold port and said first passage in said first nozzle;

a second manifold housing said second nozzle having a second manifold input port for fluid; and a second manifold passage which communicates with said second manifold input port and said first passage in said second nozzle.

7. The improved feed shell of claim 6 further comprising:

a transfer port communicating with said first manifold passage; and a transfer duct connecting with said transfer port and said second manifold input port.

8. The improved feed shell of claim 7 wherein the first guide surface has a first run onto which said first nozzle passage of said first nozzle directs fluid, and a second run onto which a second nozzle passage of said first nozzle directs fluid; and the second guide surface has a third run onto which said first nozzle passage of said second nozzle directs fluid, and a fourth run onto which a second nozzle passage of said second nozzle directs fluid.

* * * * *